US005102027A

United States Patent [19]

Se Hong

[11] Patent Number: 5,102,027

[45] Date of Patent: Apr. 7, 1992

[54] MACHINE FOR MANUFACTURING CONSTRUCTION PANELS

[76] Inventor: An Se Hong, Jookong Apartment 5-206, #1113, Banpo-dong, Seochu-Ku, Seoul, Rep. of Korea

[21] Appl. No.: 682,576

[22] Filed: Apr. 8, 1991

[30] Foreign Application Priority Data

Sep. 20, 1990 [KR] Rep. of Korea ..... 1990-14492[U]

[51] Int. Cl.[5] ..... B23K 11/00; B23K 37/00

[52] U.S. Cl. ..... 228/4.1; 228/18; 228/47

[58] Field of Search ..... 228/4.1, 5.1, 6.1, 18, 228/47, 170, 173.5, 176, 182, 189; 219/56

[56] References Cited

U.S. PATENT DOCUMENTS

| | | | |
|---|---|---|---|
| 4,500,763 | 2/1985 | Schmidt et al. | 219/56 |
| 4,667,707 | 5/1987 | DeSchutter | 219/56 |
| 4,831,699 | 5/1989 | Rozzi | 228/173.5 |
| 4,917,284 | 4/1990 | Condiracci | 228/189 |

*Primary Examiner*—Samual M. Heinrich
*Attorney, Agent, or Firm*—Michael J. Striker

[57] ABSTRACT

A machine manufactures construction panels which include a plate-shaped heat insulating core, upper and lower wires located closely at opposite sides of the heat insulating core, first and second supporting members inserted in the heat insulating core and the upper and lower wire meshes in an inclined manner opposite to one another and welded to the upper and lower wire meshes. The machine has an intermittently driven conveyor unit, a plurality of spacer angles for stacking the plate-shaped heat insulating core and the upper and lower wire meshes with certain gaps therebetween to form a panel pre-assembly to be mounted on the conveyor unit, a plurality of quick-moving and inserting sections for the first and second supporting members disposed in an inclined manner and opposite to one another. The quick-moving and inserting sections include a plurality of quick-moving units provided with a unit for accommodating and discharging one by one the first and second supporting members which are cut in advance, and a plurality of inserting units with tubes provided with a hole having a diameter slightly larger than a diameter of the first and second supporting members.

6 Claims, 6 Drawing Sheets 100
200
106
112
114
116
118
120
122
124
126
128
130
132
12
18
24

MACHINE FOR MANUFACTURING CONSTRUCTION PANELS

BACKGROUND OF THE INVENTION

The present relates to a machine for manufacturing panels for use in constructions.

More particularly, it relates to a machine which manufactures panels including two wire meshes made of wires or thin rods, a flat heat insulating core material disposed between the wire meshes, and inclinedly arranged supporting members welded with opposite inclination as viewed from a side of the panel, so as to form a three-dimensional panel for use in constructions.

Generally, the light plastics including foamed synthetic resins and expanded plastics such as urethane and polystyrene have the proper characteristics required in walls and ceilings, i.e., light weight, low heat conductivity, antiabrasion, low water intrusion, acoustic shielding property and the like. However, they are weak with regard their structural strength. Therefore, they are coupled with a reinforcing frame having a structurally stable strength while used as a construction material. Examples of such panels are disclosed in U.S. Pat. Nos. 3,305,991, 3,555,131 and 4,226,067. U.S. Pat. No. 3,305,991 discloses manufacturing process in accordance with which a complete frame is separately manufactured and inserted into a fabrication vessel and a fluid is also poured into the fabrication vessel so that the frame is immersed in the fluid to form a certain gap in the bottom of the frame and the bottom of a foamed panel to be formed. A film forming fluid is poured into the fabricating vessel to form a film on the inner surface of the fabricating vessel and a liquid foam material is poured into the fabricating vessel. Then curing is carried out so as to form a reinforced panel for use in constructions.

U.S. Pat. No. 3,555,131 discloses a device and a method for assembling such a panel. U.S. Pat. No. 4,226,067 deals with an assembling type panel manufactured in accordance with a process in which a foamed plastic is fitted between two truss shaped side frames, and a plurality of them are laterally combined in close contact with each other. Then, the upper and lower portions of the side frame are spotwelded to unite the side frames, so as to provide an assembling-type reinforced panel with reinforcing cores.

The method disclosed in U.S. Pat. No. 3,305,991 requires an enormous amount of investment in the facility since it uses the manufacturing device of U.S. Pat. No. 3,555,131, which is expensive special device for manufacturing an integrated frame. Furthermore, the foamings have to be carried out one by one in the fabricating vessel and therefore it is impossible to produce the foamed panels in a mechanized manner. Also, it is not only difficult to maintain a constant gap between the surface of the foamed resin and the surface of the integrated frame, but also irregularity occurs on the surface of the foamed resin, the position of the foamed resin is not made in an accurate fashion. Furthermore the foamed body is actually contacted with the external frame at many places and therefore when finishing is carried out with a cement mortar, the placing of the united frame cannot be perfect.

In accordance with the method of U.S. Pat. No. 4,226,067, small gaps between the heat insulating cores which are filling members arranged in lateral direction can occur. Therefore the heat insulating and acoustic shielding characteristics are reduced and the manufacturing process is complicated.

Korean Patent 21,625 provided solutions to the problems of the device described hereinabove. The present invention is a further improvement of the manufacturing machine for manufacturing the heat insulating panels, disclosed in 21,625. Korean Patent 21,625 discloses a manufacturing machine in which the upper and lower wire meshes are disposed above and below the heat insulating core with certain gaps therebetween, are fitted into a jig. The jig is intermittently moved a certain distance, and at the same time a wire which is to serve as supporting members for the wire meshes and the heat insulating core is continuously inclinedly inserted and cut off. Then, the contacts between the cut supporting members and the upper and lower wire meshes is spot welded so as to form three-dimensional construction panels.

Usually, the construction panels have a width of 1.22 m (4 feet) and a length 2.44–4.27 (8–14 feet). Due to this great size it is advantageous to produce the panels near the consuming place rather than to transport them a long distance.

The machine of Korean Patent 21,625 has an advantage that the panels having heat insulating cores of superior heat insulating characteristics and acoustic shielding characteristics can be mass-produced. However, it has disadvantages in that the means for supplying the inclined wires is very complicated and consumes a large amount of energy. The bulk and the number of components for the means are too large, so that it is difficult to carry them to the consuming places. Also, this results in difficulties for repair and maintenance. The process for assembling the upper and lower wire meshes can be heat insulating cores to keep a certain gap between them is very troublesome and affects the productivity in a deteriorating fashion.

SUMMARY OF THE INVENTION

Accordingly, it is an object of the present invention to provide a machine for manufacturing panels for use in construction, which avoids the disadvantages of the prior art.

In keeping with these objects and with others which will become apparent hereinafter, one feature of the present invention resides, briefly stated, in a machine for manufacturing construction panels, in which a conveyor mounts upper and lower wire meshes and flat heat insulating cores with a certain gap therebetween by means of spacer angles, and the combination of the upper and lower wire meshes and the heat insulating cores are intermittently moved toward a section where the support members are speedily moved and inserted into the heat insulating cores.

In the inventive machine for manufacturing construction panels, by means of an ordinary supplying device having rotary dischange drums and by means of an inserting device having a plunger, supporting member wires which are fed in cut state are inserted into the combination of the upper and lower wire meshes and the heat insulating cores which are intermittently moved.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENT

Figure 1:
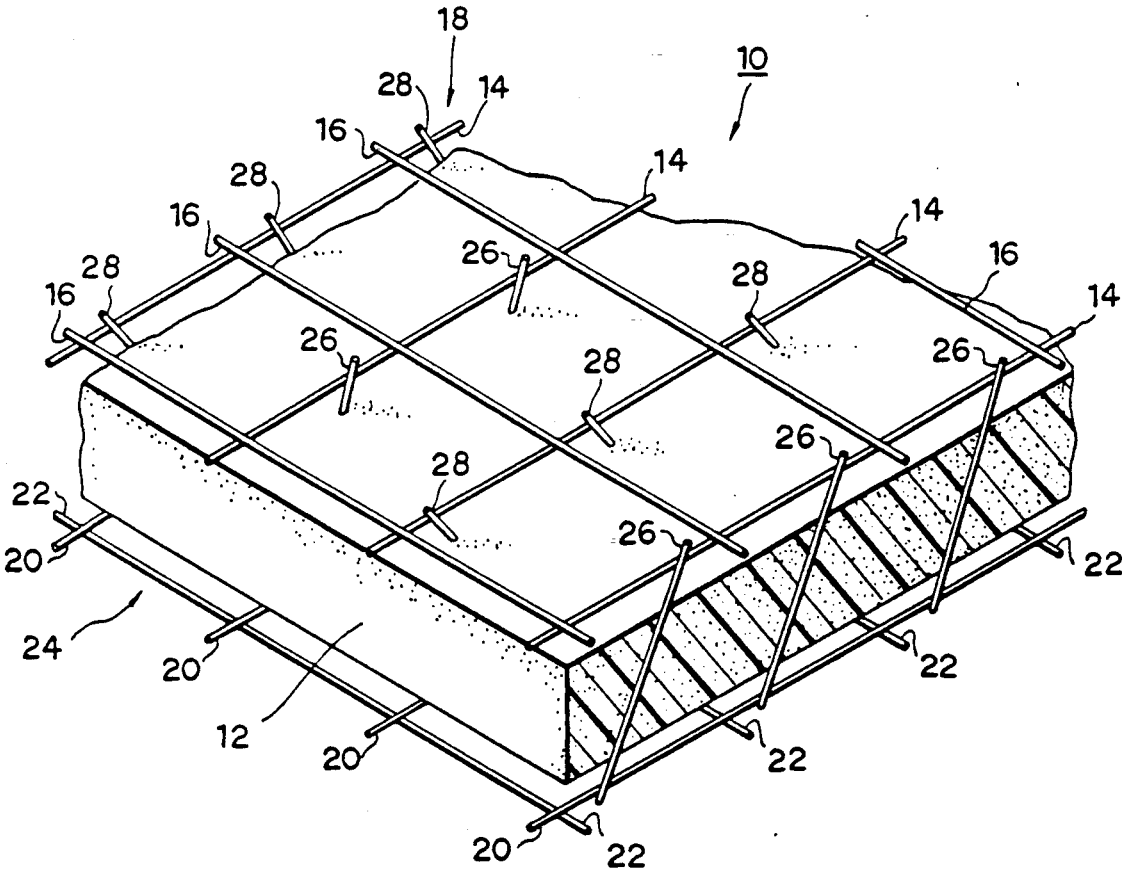
FIG. 1 is a perspective view of a part of a panel manufactured by a machine in accordance with the present invention.

A panel 10 made by a machine in accordance with the present invention is formed as a three-dimensional structure in accordance with FIG. 1. In particular the panel 10 includes a plate-shaped insulating core 12 which is placed between an upper wire mesh 18 and a lower wire mesh 24 with gaps therebetween. The upper wire mesh 18 includes a plurality of longitudinal wires 14 and lateral wires 16 arranged with gaps therebetween. The lower wire mesh 24 has a plurality of longitudinal wires 20 and lateral wires 22 arranged with gaps therebetween.

Supporting members are inserted in different directions through the upper wire mesh 18, the heat insulating core 12, and the lower wire mesh 24. Supporting members include a first supporting member 26 and a second supporting member 28 inclined in different directions. The opposite tips of the first and second supporting members 26, 28 are spot welded to the longitudinal wires 14, 20 of the upper and lower wire meshes 18, 24.

Figure 2:
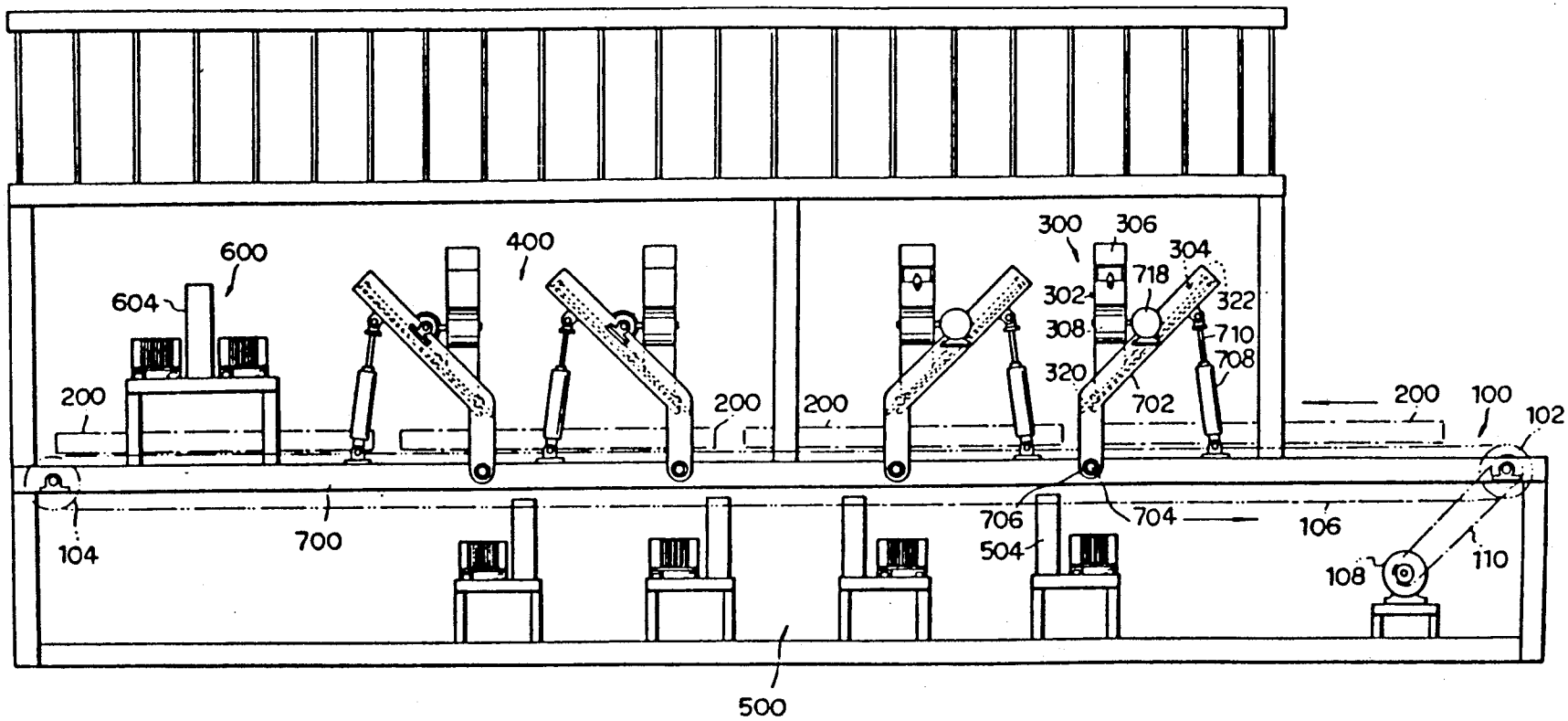
FIG. 2 is a schematic side view of the manufacturing machine in accordance with the present invention.

As shown in FIG. 2, a conveyor 100 intermittently moves a preassembly 200 stacked with a certain gap and including the upper and lower wire meshes and the heat insulating core. The preassembly is moved toward a first supporting member quick-moving and inserting section 300 and a second supporting member quick-moving and inserting section 400, which are located opposite to and face each other at the same inclined angle. A lower welding section 500 is located below the first and second supporting member quickmoving and inserting sections 300, 400, while an upper welding section 600 is located at a side of the second supporting member quick-moving and inserting section 400. The conveyor 100 is of an ordinary chain type. It is formed so that a driving chain 106 is located between a driving sprocket wheel 102 and an idler sprocket wheel 104. The driving chain 106 is driven by a step motor 108 and a power transmission chain 110.

Figures 3, 4A, 4B:
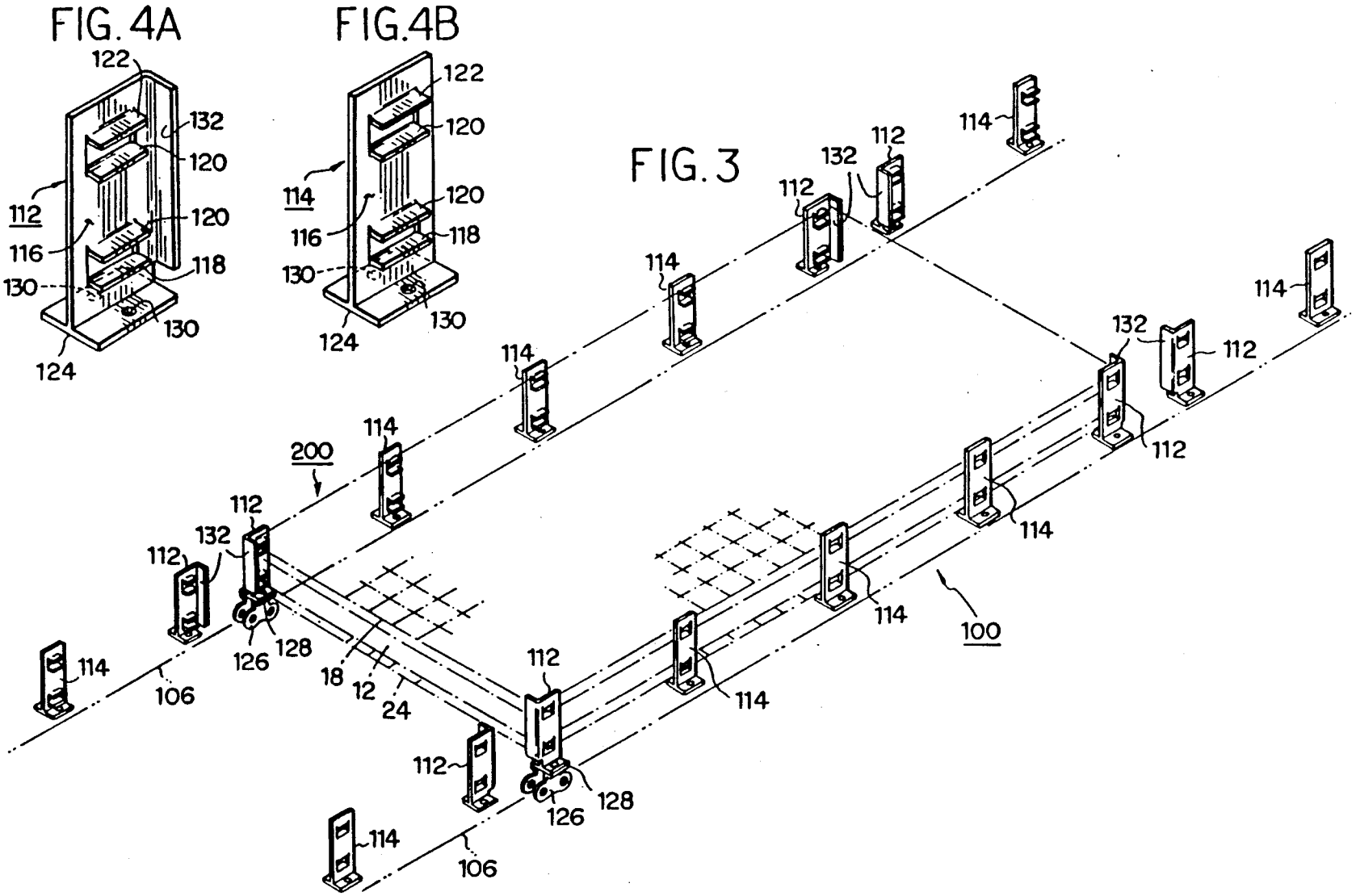
FIG. 3 is a perspective view of a part of a conveyor of the inventive machine, for carrying upper and lower wire meshes and heat insulating cores.
FIG. 4A is a perspective view of a spacer angle for securing the upper wire mesh, the heat insulating core and the lower wire mesh with certain gaps therebetween, and which operates at a corner of the panel mounted on the conveyor of FIG. 3.
FIG. 4B is a perspective view of a spacer angle for securing the upper wire mesh, the heat insulating core and the lower wire mesh with certain gaps therebetween, and which operates at a middle portion of the panel mounted on the conveyor of FIG. 3.

FIG. 3 shows a specific embodiment of the conveyor 100. The driving chain 106 includes a pair of synchronous chains. A plurality of corner spacer angles 112 are attached to the driving chain 106 at intervals corresponding to the length of the panel to be manufactured, while middle spacer angles 114 are attached between the corner spacer angles at certain intervals.

FIGS. 4A and 4B show in detail the construction of the corner spacer angles 112 and the middle spacer angles 114. The corner spacer angles 112 are provided with protuberances 118, 120, 122 on a vertical plate portion 116 arranged with certain intervals. The protuberance 118 supports a lower wire mesh 24, the protuberance 120 supports the plate shaped heat insulating core 12, and the protuberance 122 supports the upper wire mesh 18. A horizontal plate portion 124 is provided with a hole 130 formed to match with a hole on a horizontally bent portion 128 of an outer link member 126 of the driving chain 106 shown in FIG. 3. The vertical plate portion 116 of the corner spacer angle 112 is provided with a vertical wall formed to surround the four corners of the panel pre-assembly 200.

The middle spacer angle 114 has the same construction as the corner spacer angle 112, except that the former does not have the vertical wall 132. In the spacer angles 112, 114 the intervals of the protuberances 118, 120, 122 can be varied, depending on the thickness of the panel to be manufactured, or in other words, depending on the thickness of the heat insulating core. Therefore, it is desirable to provide convenient disassembling of the spacer angles 112 and 114 from the driving chain 106 and assembling the same to the driving chain. For this purpose a horizontal plate portion 124 of the spacer angles 112 and 114 and the portion 128 of the outer link member 126 extending from the drive chain 106 in the horizontal direction are formed so that the outer spacer angles with different intervals of the protuberances 118, 120, 122 can be used in a compatible manner by not shown bolts and nuts. Preferably, the intervals of the protuberances 118, 120, 122 can be varied within the spacer angles. However, this requires high costs and complicated construction while it can eliminate the problem of replacing the spacer angles.

Figure 5:
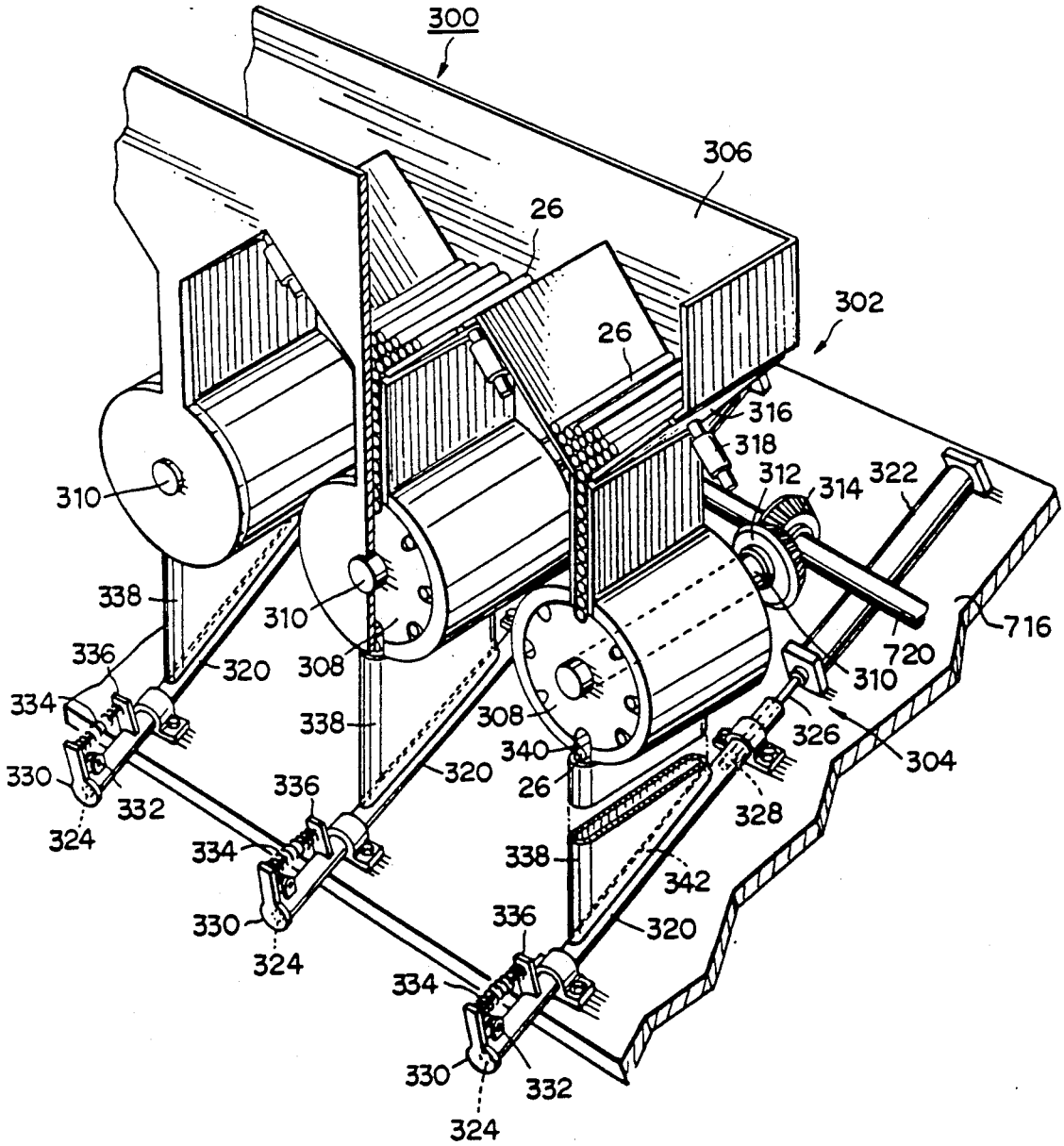
FIG. 5 is a perspective view of a section where the supporting members are speedily moved and inserted into the combination of the upper wire mesh, the heat insulating core and the lower wire mesh, which section is a part of the inventive manufacturing machine.

The quick-moving and inserting section 300 of the first supporting member and the quick-moving and inserting section 400 of the second supporting member are installed on a main frame 700 so that they face each other oppositely with the same inclination angle as shown in FIGS. 2 and 5. The sections 300 and 400 are supported on an arm 702. A lower portion of the arm 702 is mounted on the main frame 700 by a retaining gap 704 and a bearing 706. The upper portion of the arm 702 is connected by a pin 712 in a pivotable manner to a piston rod 710 extending from a hydraulic cylinder 708. The hydraulic cylinder 708 is secured to the main frame 700 by a pin 714 so that its inclination angle can be adjusted. Only one of them is shown in the drawings.

The quick-moving and inserting sections 300, 400 for the first and second supporting members are identical and differ only in their installing positions. The quick-moving and inserting section 300 of the first supporting member will be described hereinbelow.

The quick-moving and inserting section 300 of the supporting member is shown in FIG. 5. It includes a plurality of quick-moving units 302 and inserting units 304. The quick-moving 302 and the inserting units 304 are arranged on a base plate 716 which is secured on the arm 702 as shown in FIG. 2. The quick-moving units 302 includes a discharge drum 308 for discharging the first supporting members 26 one by one at certain intervals from a hopper 306. The first supporting members 26 which have been cut in advance are accommodated in the hopper 306. A bevel gear 312 is secured to a tip of a rotary shaft 310 of the discharge drum 308 and meshes with another bevel gear 314 secured to a rotary shaft 720. The rotary shaft 720 is intermittently rotated by a step motor 718 connected to the arm 702 of FIG. 2.

A movable vibration plate 316 is formed on a part of an inclined wall of the hopper 306. The vibration plate 316 is vibrated by a vibrator 318 so that the first supporting members 26 can be smoothly discharged. The inserting unit 304 includes a pneumatic cylinder 322 and a tube 320 fixed to the base plate 716.

The tube 320 has a hole 324 with a diameter slightly larger than the diameter of the first supporting member 26. A plunger 326 connected with the piston of the pneumatic cylinder 322 is inserted through one end of the hole 324. A magnetic tip 322 is attached at the leading end on the plunger 326 for preventing the slipping of the first supporting members 26 due to self-gravity. It also pushes the first supporting members 26 in a stable manner.

A door 330 is pivotally mounted at the leading end of the tube 320 by a pin 332 in order to close or open the hole 324. A compression spring 333 is elastically mounted on the back of the door 330, while the other end of the compression spring 334 is supported by a protuberance 336 fixed on the tube 320.

The quick-moving unit 302 and the inserting unit 304 are connected with one another by a chute 338. The upper portion of the chute 338 is in contact with the discharge hole 340 located directly below the discharge drum 308, while the lower portion of the chute 338 is in contact with a slot 342 formed on the upper middle portion of the tube 320.

Figure 6:
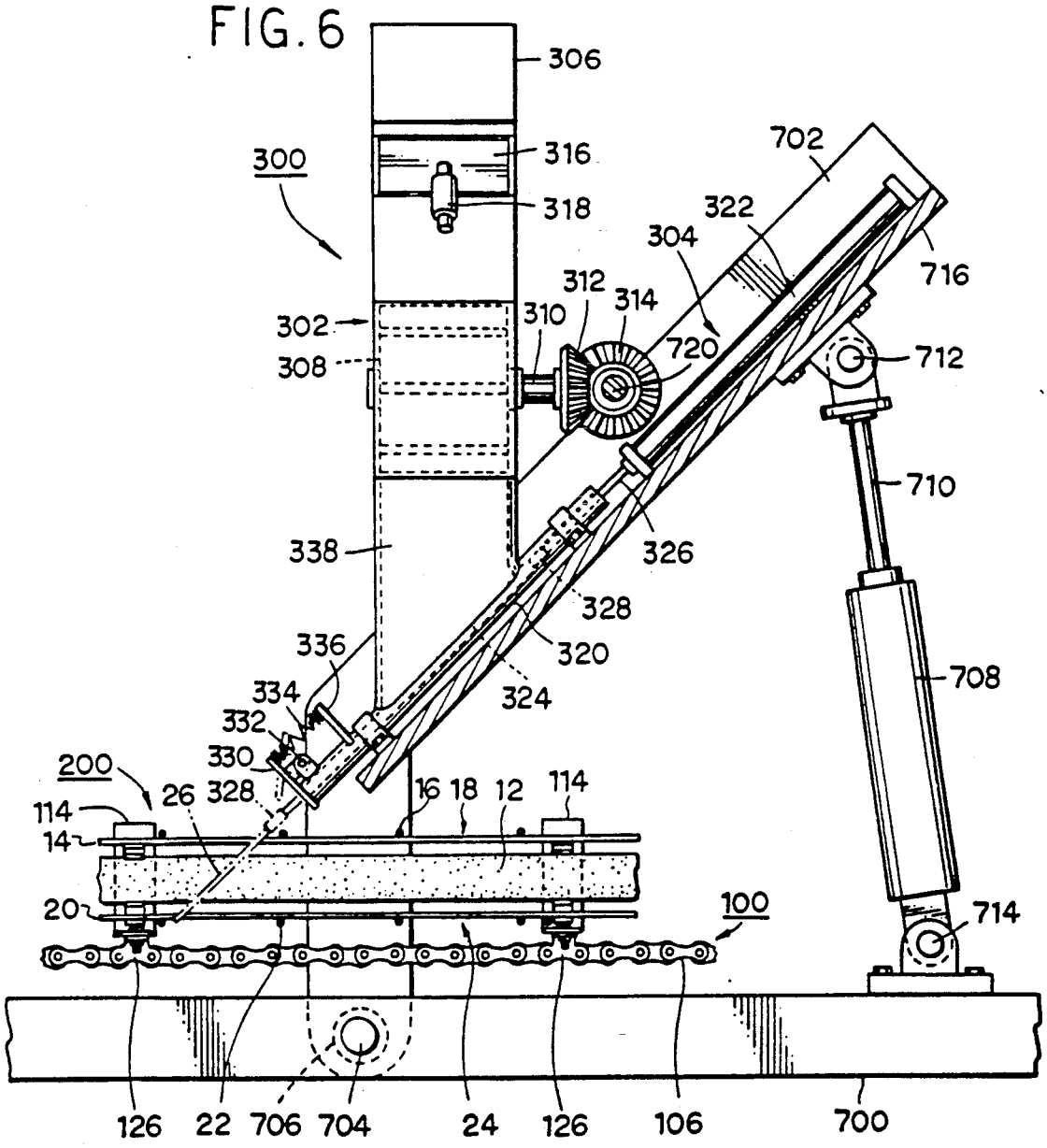
FIG. 6 is a partially cut-out side view illustrating the state of speedily moving and inserting the supporting member into the combination of the upper wire mesh, the heat insulating core and the lower wire mesh, moved by the conveyor of FIG. 3.

As shown in FIG. 6, the first supporting member 26 which is fed through the quick-moving unit 302, the chute 338 and the slot 342 of the tube 320 into this tube, is inserted into the upper wire mesh 18, the heat insulating core 12 and lower wire mesh 24 of the panel pre-assembly 200 conveyed by the conveyor 100. Before such an insertion, the first supporting member 26 pushes away the door 330 which has been blocking the hole 324 by the elastic force of the compression spring 334, being carried by the magnetic tip 328 of the leading end of the plunger 326 extending from the pneumatic cylinder 322.

Figure 7:
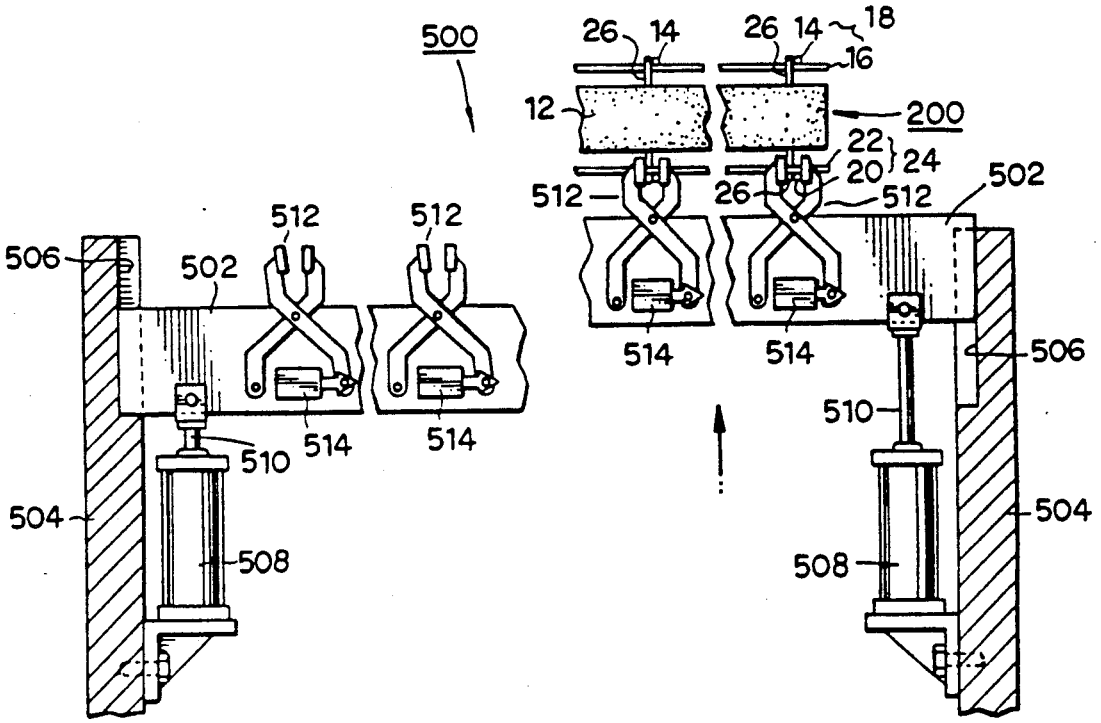
FIG. 7 is a partially cut-out frontal view of the lower welding section which is used for welding the lower wire mesh and the supporting member, of the machine in accordance with the present invention.

FIG. 7 shows the construction and the operation of the lower welding section 500 for spot welding of the first supporting member 26 and the longitudinal wire 200 of the lower mesh 24. The opposite end portions of a vertically installed actuating plate 502 are inserted into sliding grooves 506 of the upper portions of the opposite supporting frames 504. A piston rod 510 of pneumatic cylinder 508 is secured to the bottom of the actuating plate 502, and a cylinder 508 is arranged below the opposite supporting frames 504. Spot welders 512 are arranged on one side of the actuating plate 502 at the same intervals as the installing intervals of the insertion units of FIG. 5. The spot welders 512 are operated by solenoids 514.

Figure 8:
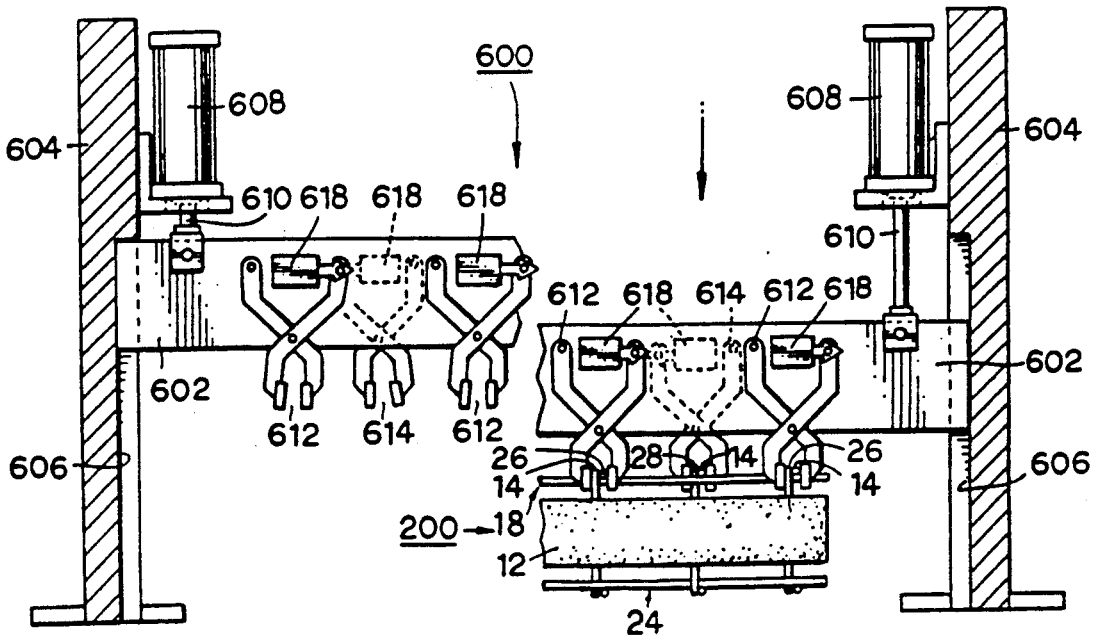
FIG. 8 is a partially cut out frontal view of the upper welding section which is used for welding the upper wire mesh and the supporting member, of the manufacturing machine in accordance with the present invention.

FIG. 8 shows the construction and the operation of the upper welding section 600 for spot welding of the first and second supporting members 26, 28 and the longitudinal wires 20 of the upper wire mesh 18. The first and second supporting members 26 and 28 are inserted after the panel pre-assembly 200 has passed the quick-moving and inserting section 300 of the first supporting member and the quickmoving and inserting section 400 of the second supporting member.

The opposite end portions of the vertically arranged actuating plate 602 are inserted into sliding grooves 606 formed on the bottom of the supporting frame 604. A piston rod 610 of a pneumatic cylinder 608 is fixed on the opposite end portions of the actuating plate 602, while the pneumatic cylinders 608 are fixed to the upper portion of the supporting frame 604.

Spot welders are installed at the opposite sides of the actuating plate 602 at intervals which are identical to the interval of the first and second supporting members 26 and 28 or in other words at the intervals of the inserting units of the quick-moving and inserting sections 300 and 400 of the first and second supporting members are arranged together. The spot welders 612 for spot welding of the first supporting members 26 to the longitudinal wires 20 of the upper wire mesh 18 are arranged on one side of the actuating plate 602 while spot welders 614 for spot welding of the second supporting members 28 and the longitudinal wires 20 of the upper mesh 18 are installed at the other side of the actuating plate 602. The spot welders 612 and 614 are operated by solenoids 618. The operating means of the spot welders 612, 614 are not limited to the solenoids 514, 618. The solenoids can be replaced with small pneumatic cylinders, depending on circumstances of the operation.

In accordance with the present invention, the panel pre-assemblies 200 including the lower wire mesh 24, the heat insulating core 12 and the upper wire mesh 18 stacked with certain gaps by the spacer angles 112, 114 are mounted with certain intervals on the conveyor 100 which is intermittently moved by a step motor 108. Then the first and second supporting members 26 and 28 which are cut in advance to a certain length are inserted into the panel pre-assembly by the quick-moving and inserting sections 300 and 400 of the first and second supporting members. Then the first and second supporting members 26 and 28 and the longitudinal wires 14, 20 of the upper and lower wire meshes 18, 24 are spot welded together by the upper and lower spot welding section 500 and 600, so that the manufacture of the panel 10 of FIG. 1 is completed. The panel pre-assembly 200 can therefore directly manufactured on the conveyor 100. Further, the first and second supporting members 26, 28 are cut in advance and therefore the constructions of the means for inserting the first and second supporting members 26, 28 into the panel pre-assembly 200 are simplified. Also, a light weight and simplification of the insertion of the first and second supporting members 26, 28 are achieved. As a result, the productivity is improved and the bulk weight of the manufacturing facility are reduced, so as to make possible to arrange the manufacturing facility near to the consuming place and to provide a convenience for repair and maintenance of the machine.

It will be understood that each of the elements described above, or two or more together, may also find a useful application in other types of constructions differing from the types described above.

While the invention has been illustrated and described as embodied in a machine for manufacturing construction panels, it is not intended to be limited to the details shown, since various modifications and structural changes may has made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

I claim:

1. A machine for manufacturing construction panels which include a plate-shaped heat insulating core, upper and lower wires located closely at opposite sides of the heat insulating core, first and second supporting members inserted in the heat insulating core and the upper and lower wire meshes in an inclined manner opposite to one another and welded to the upper and lower wire meshes, the machine comprising intermittently driven conveyor means; a plurality of spacer angles for stacking the plate-shaped heat insulating core and the upper and lower wire meshes with certain gaps therebetween to form a panel pre-assembly to be mounted on said conveyor means; a plurality of quick-moving and inserting sections for the first and second supporting members disposed in an inclined manner and opposite to one another, said quick-moving and inserting sections including a plurality of quick-moving units provided with means for accommodating and discharging one by one the first and second supporting members which are cut in advance, and a plurality of inserting units with tubes provided with a hole having a diameter slightly larger than a diameter of the first and second supporting members.

2. A machine as defined in claim 1, wherein said conveying means include a conveyor and a step motor for intermittently driving said conveyor.

3. A machine as defined in claim 1; and further comprising an arm and a base plate secured on said arm, said quick-moving and inserting sections of said first and second supporting members are installed on said base plate.

4. A machine as defined in claim 1, wherein said accommodating and discharging means include a hopper for accommodating the first and second supporting members and discharge drums for discharging the first and second supporting members.

5. A machine as defined in claim 1, wherein said inserting units include a plurality of pneumatic cylinders provided with plungers.

6. A machine as defined in claim 5, wherein said plunger of said inserting unit has a leading end; and further comprising a magnetic tip attached to said leading end of said plunger.

* * * * *